US009408522B2

(12) United States Patent
Wang et al.

(10) Patent No.: US 9,408,522 B2
(45) Date of Patent: Aug. 9, 2016

(54) FRYER CLEANING TOOL WITH CLEANING HEAD WITH CLEANING PAD SLIDABLY MOUNTABLE THEREON

(71) Applicant: 3M INNOVATIVE PROPERTIES COMPANY, St. Paul, MN (US)

(72) Inventors: DanLi Wang, Shoreview, MN (US); Martin E. Broen, Milan (IT); Perry S. Dotterman, Maplewood, MN (US); Robert J. Maki, Hudson, WI (US); Kim C. Sachs, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 525 days.

(21) Appl. No.: 13/769,640

(22) Filed: Feb. 18, 2013

(65) Prior Publication Data

US 2013/0233347 A1 Sep. 12, 2013

Related U.S. Application Data

(60) Provisional application No. 61/608,724, filed on Mar. 9, 2012.

(51) Int. Cl.

| | |
|---|---|
| ***A47L 13/44*** | (2006.01) |
| ***A47L 17/06*** | (2006.01) |
| ***A47L 17/08*** | (2006.01) |

(52) U.S. Cl.

CPC ..... *A47L 17/08* (2013.01); *A47L 13/44* (2013.01); *A47L 17/06* (2013.01)

(58) Field of Classification Search

CPC ..... A47L 13/44; A47L 17/00; A47L 17/06; A47L 17/08

See application file for complete search history.

(56) References Cited

U.S. PATENT DOCUMENTS

| | | | |
|---|---|---|---|
| 230,260 | A | 7/1880 | Ferguson |
| 705,983 | A | 7/1902 | Volckening |
| 1,558,509 | A | 10/1925 | Schweitzer |
| 2,635,274 | A | 4/1953 | Hatcher |
| 2,669,741 | A | 2/1954 | Jelliffe |
| 2,686,327 | A | 8/1954 | King |
| 2,816,313 | A | 12/1957 | Beck |
| 2,958,593 | A | 11/1960 | Hoover |
| 3,473,183 | A | 10/1969 | Burns |
| 3,491,397 | A | 1/1970 | Hesener |
| 3,537,121 | A | 11/1970 | McAvoy |
| 3,837,988 | A | 9/1974 | Hennen |
| 3,910,284 | A | 10/1975 | Orentreich |

(Continued)

FOREIGN PATENT DOCUMENTS

| | | |
|---|---|---|
| CN | 2647219 | 10/2004 |
| JP | 2005-066324 | 3/2005 |
| WO | WO 2009-125376 | 10/2009 |

OTHER PUBLICATIONS

International Search Report, PCT/US2013/028659, mailed Jun. 27, 2013, 3 pages.

(Continued)

*Primary Examiner* — Randall Chin

(74) *Attorney, Agent, or Firm* — Emily Van Vliet; Kenneth B. Wood

(57) ABSTRACT

A fryer cleaning tool with a sheetlike cleaning head configured to receive a sheetlike resilient fryer cleaning pad with an open-ended slitlike cavity therewithin, which pad can be slidably mounted onto the cleaning head.

19 Claims, 7 Drawing Sheets

(56) References Cited

U.S. PATENT DOCUMENTS

| | | | | |
|---|---|---|---|---|
| 4,078,340 | A | 3/1978 | Klecker | |
| 4,227,350 | A | 10/1980 | Fitzer | |
| 4,317,249 | A | 3/1982 | Benson | |
| 4,517,700 | A | 5/1985 | Pinto | |
| 4,856,136 | A | 8/1989 | Janssen | |
| 5,323,506 | A | 6/1994 | Babitch | |
| 5,592,713 | A | 1/1997 | Rones | |
| 5,865,935 | A | 2/1999 | Ozimek | |
| 5,953,784 | A | 9/1999 | Suzuki et al. | |
| 5,996,161 | A | 12/1999 | Facca | |
| 6,023,810 | A | 2/2000 | Gessert | |
| 6,047,435 | A | 4/2000 | Suzuki | |
| 6,094,770 | A * | 8/2000 | Benarrouch | A47J 13/022 15/209.1 |
| 6,560,811 | B1 | 5/2003 | Krause | |
| 6,775,874 | B2 | 8/2004 | Horton | |
| 7,032,270 | B2 | 4/2006 | Vitantonio | |
| 7,293,317 | B2 | 11/2007 | Tsuchiya | |
| D580,117 | S | 11/2008 | Shaw | |
| D648,911 | S | 11/2011 | Brown | |
| 2003/0135946 | A1 | 7/2003 | Maclean | |
| 2005/0066464 | A1 | 3/2005 | McKay | |
| 2006/0053574 | A1 | 3/2006 | Steinberg | |
| 2008/0028555 | A1 | 2/2008 | Petner | |
| 2008/0216260 | A1 | 9/2008 | Silverman | |
| 2009/0255075 | A1 | 10/2009 | Carlson | |
| 2011/0191974 | A1 * | 8/2011 | Holcomb | A47J 43/288 15/236.01 |
| 2011/0197917 | A1 | 8/2011 | Koptis | |
| 2011/0225755 | A1 | 9/2011 | Carlson | |

OTHER PUBLICATIONS

Extended European Search Report, EP13757059.4, dated Dec. 9, 2015, 3 pages.

* cited by examiner

FRYER CLEANING TOOL WITH CLEANING HEAD WITH CLEANING PAD SLIDABLY MOUNTABLE THEREON

BACKGROUND

Fryers, e.g. commercial fryers found in restaurants, can be difficult to clean due to the complex geometry of the frying vat and the heating elements therein, and due to the difficulty of removing e.g. burnt materials that are strongly adhered to fryer surfaces.

SUMMARY

Herein is disclosed a fryer cleaning tool with a sheetlike cleaning head configured to receive a sheetlike resilient fryer cleaning pad with an open-ended slitlike cavity therewithin, which pad can be slidably mounted onto the cleaning head. These and other aspects of the invention will be apparent from the detailed description below. In no event, however, should the above summaries be construed as limitations on the claimable subject matter, whether such subject matter is presented in claims in the application as initially filed or in claims that are amended or otherwise presented in prosecution.

Like reference numbers in the various figures indicate like elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. As used herein, terms such as forward, forwardly, forwardmost, forward-facing, etc., denote a direction toward the working end of a cleaning tool (e.g., toward the left side of FIG. 1); terms such as rearward, rearwardly, rearwardmost, rear-facing, etc. denote a direction toward the grippable end of a cleaning tool (e.g., toward the right side of FIG. 1). As used herein, terms such as outward, outwardly, outward-facing, outwardmost, etc. denote a direction outward from the interior of a cleaning head; terms such as inward, inwardly, inward-facing, inwardmost, etc. denote a direction inward toward the interior of a cleaning head.

DETAILED DESCRIPTION

Figure 1:
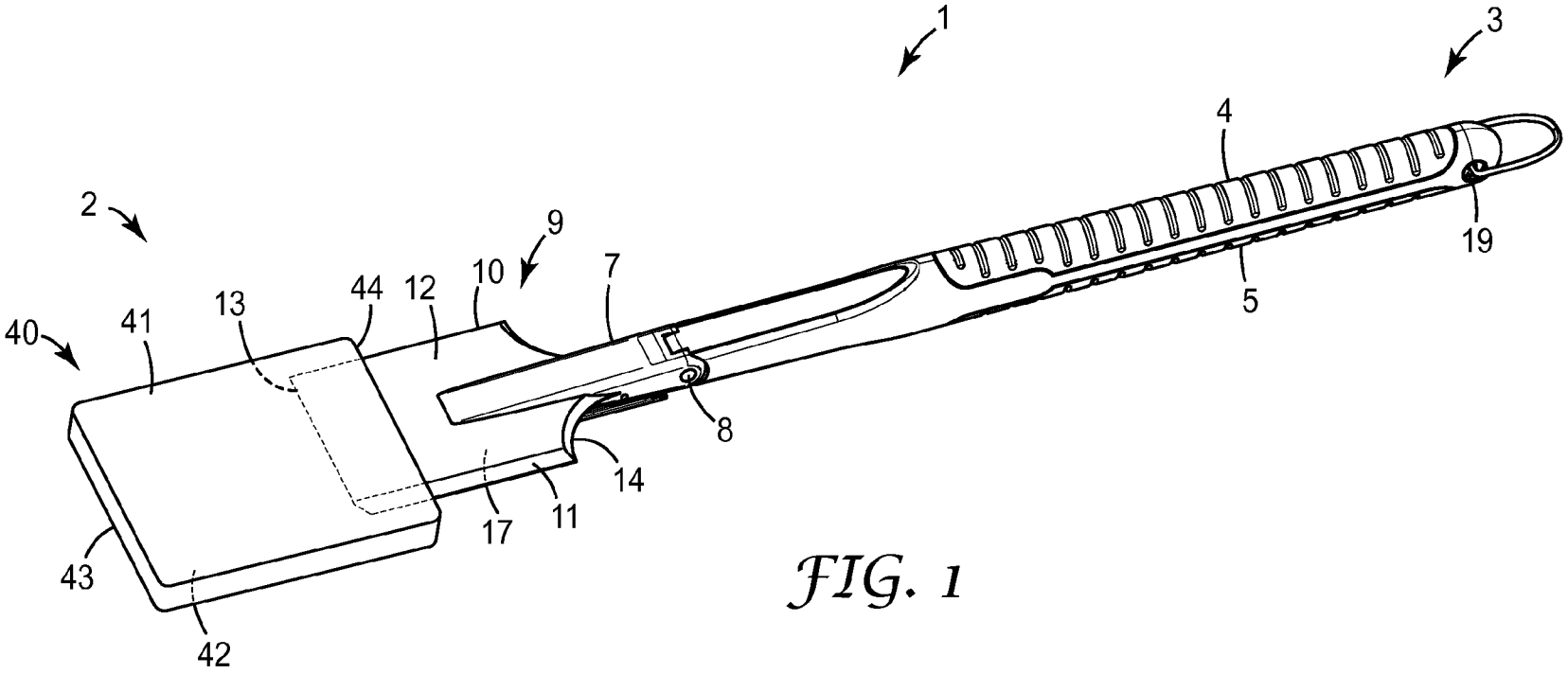
FIG. 1 is a perspective partially exploded view of an exemplary generic fryer cleaning tool with an exemplary fryer cleaning pad partially slidably mounted on a cleaning head of the cleaning tool.

Shown in generic representation in FIG. 1 in partially exploded perspective view, is an exemplary fryer cleaning tool 1 that may be used for cleaning of e.g. commercial fryers as found in restaurants and the like. Specific exemplary embodiments of cleaning tool 1 are shown in perspective view in FIG. 2 (with a cleaning pad mounted thereon as disclosed later herein), and in FIG. 3 (without a cleaning pad mounted thereon), and in FIGS. 4 and 5 in top and side views respectively. Fryer cleaning tool 1 comprises a handle comprising an elongated shaft 4 that connects sheetlike cleaning head 9 at the first, working end 2 of tool 1, to second, grippable end 3 of tool 1. Grippable end 3 comprises a grippable portion 5 with a long axis (noting that an item does not necessarily have to be perfectly straight to have a long axis, as long as a long axis can be distinguished), and may comprise grippable material 6. Grippable material 6 may comprise a separate material mounted onto grippable portion 5 of shaft 4; or, portion 5 of shaft 4 and grippable material 6 thereof may be integrally comprised of the same material. In particular, if shaft 4 is made of metal, grippable material 6 may comprise a material (e.g., a molded coating) with thermal conductivity lower than that of the metal of shaft 4. Grippable end 3 of shaft 4 may optionally comprise a hole 19, or any other suitable pin or bracket, from which tool 1 may be suspended if desired.

Figure 2:
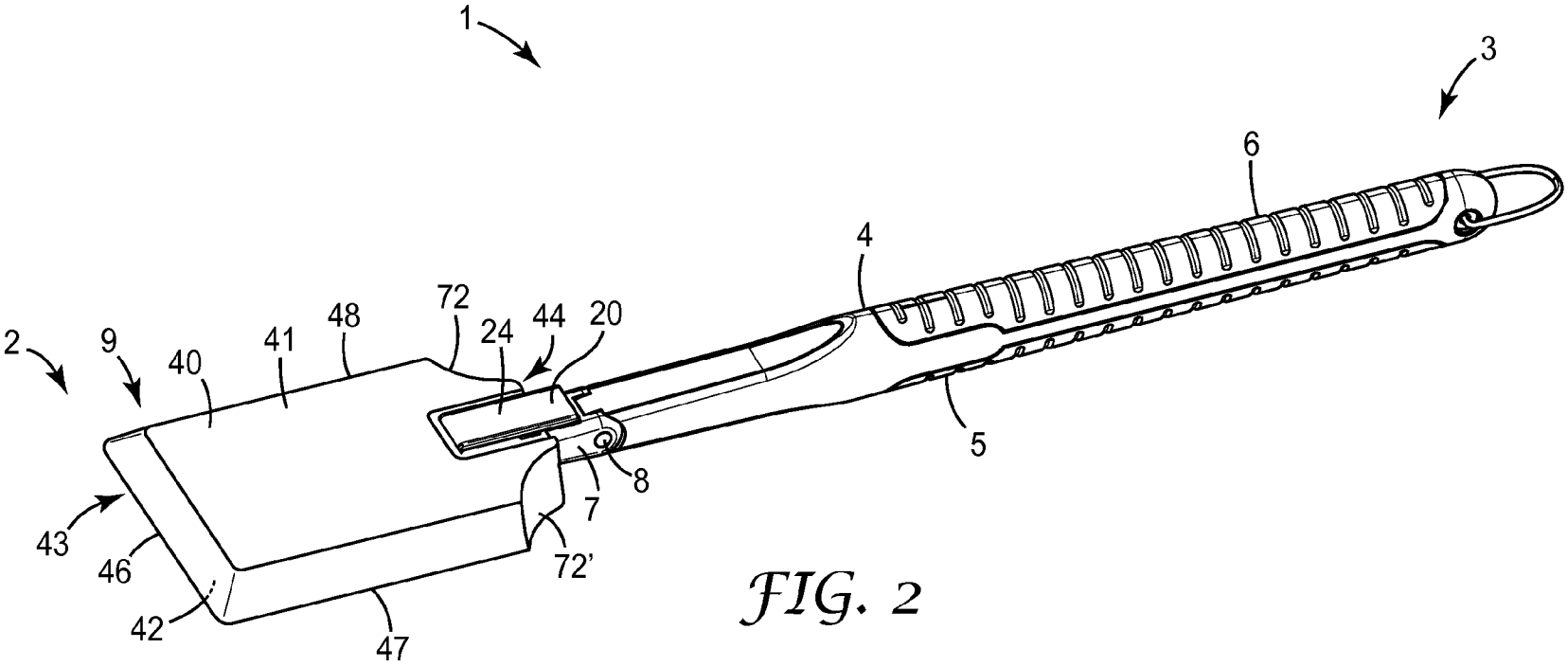
FIG. 2 is a perspective view of another exemplary fryer cleaning tool with another exemplary fryer cleaning pad mounted on a cleaning head of the cleaning tool.

As shown in exemplary embodiment in FIGS. 1 and 2, shaft 4 may comprise a connection 8 that hingedly connects grippable portion 5 of shaft 4 (which may be a major portion of shaft 4) to extender portion 7 of shaft, that connects to cleaning head 9 at working end 2 of tool 1. Such a hinged connection can allow the angle between grippable portion 5 and cleaning head 9 to be varied as desired by a user (as shown in exemplary embodiment in FIG. 5). (Instead of a hinged connection being provided within the length of shaft 4, as shown in these exemplary illustrations, it is also possible for shaft 4 to be connected to cleaning head 9 by way of a hinged connection.) In some embodiments, portions 5 and 7 of shaft 4, and in some cases the entirety of shaft 4, may be comprised of a rigid material (e.g., a rigid metal), with the only ability of tool 1 to bend or flex to any significant extent being provided by hinged connection 8 between portions of shaft 4 or between shaft 4 and cleaning head 9. In various embodiments, the length of extender section 7 can be e.g. 0.2, 0.5, 1, 2, or 4 cm, or more.

In various embodiments, the angle between shaft 4 and cleaning head 9 (meaning specifically the angle between a long axis of grippable portion 5 of shaft 4 and a long axis of cleaning head 9) that is permitted by hinged connection 8, may range from zero (i.e., when the long axes are aligned) to plus or minus 20, 30, or 40 degrees. Hinged connection 8 may be arranged so that the angle can be set only in certain increments (e.g., of 10 degrees, 20 degrees, or 30 degrees); or it may be arranged so that any angle within these overall limits can be provided. In some embodiments, a mechanism may be provided so that hinged connection 8 can be unlocked to permit the angle to be changed, after which the mechanism may be locked so that the desired angle is maintained even when significant force is placed on tool 1.

Figure 3:
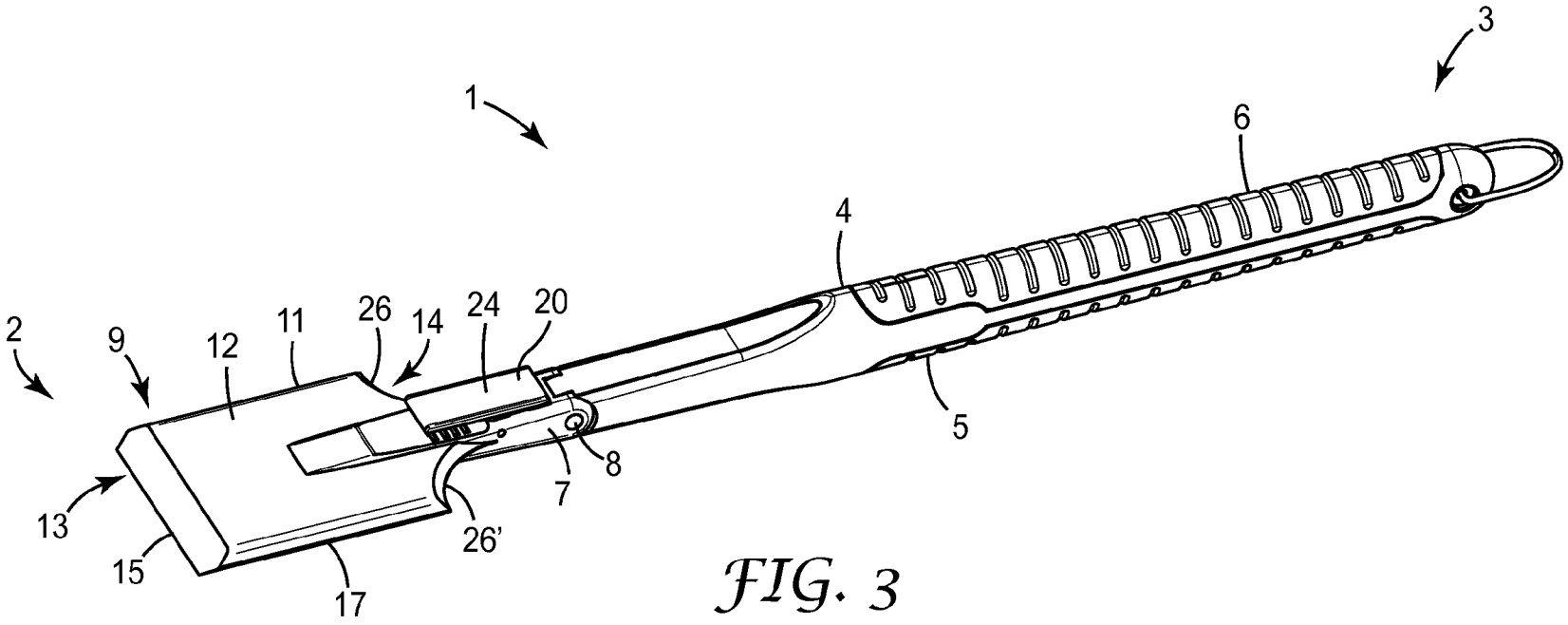
FIG. 3 is a perspective view of the tool of FIG. 2, without a fryer cleaning pad mounted on the cleaning head thereof.

As mentioned above, tool 1 comprises sheetlike cleaning head 9. As used herein, sheetlike means an item has readily discernible first and second major surfaces (e.g., surfaces 12 and 17 as shown in FIGS. 1 and 3), with a distance (thickness) between the two surfaces (averaged over the area of the cleaning head in the case of a nonuniform thickness) being less than about 20% of the length of the item along its longest dimension (which longest dimension, in the exemplary illustrations of FIGS. 1 and 3, is the length of cleaning head 9 along the direction generally aligned with shaft 4). Sheetlike cleaning head 9 may further comprise a width (which in the exemplary illustration of FIG. 1 is the distance between first and second side edges 10 and 11), and a forward edge 13 and a rearward edge 14. (It is noted that the longest dimension of cleaning head 9 does not necessarily have to be generally aligned with shaft 4; rather, cleaning head 9 could be generally square-shaped, or could have a longest dimension that is generally perpendicular to shaft 4.)

Sheetlike cleaning head 9 is configured to receive sheetlike resilient fryer cleaning pad 40 that comprises an open-ended slitlike cavity 45 therewithin (seen most clearly in FIG. 8 and described in detail later herein). Pad 40 can be slidably mounted onto cleaning head 9 (e.g., as shown in FIG. 1) so that a major portion (defined as at least 65%) of cleaning head 9 resides within the slitlike cavity of pad 40. In further embodiments, at least 75, 85, or 95% of cleaning head 9 resides within the slitlike cavity. When pad 40 is secured in place upon head 9, first and second major surfaces 12 and 17 of cleaning head 9 support first and second oppositely-facing major cleaning surfaces 41 and 42 of cleaning pad 40. Cleaning head 9 may be rigid (although it may comprise at least one movable component e.g. a part of a fastener, as discussed below) and may be made e.g. of metal or of molded polymeric resin or a combination thereof.

Figure 4:
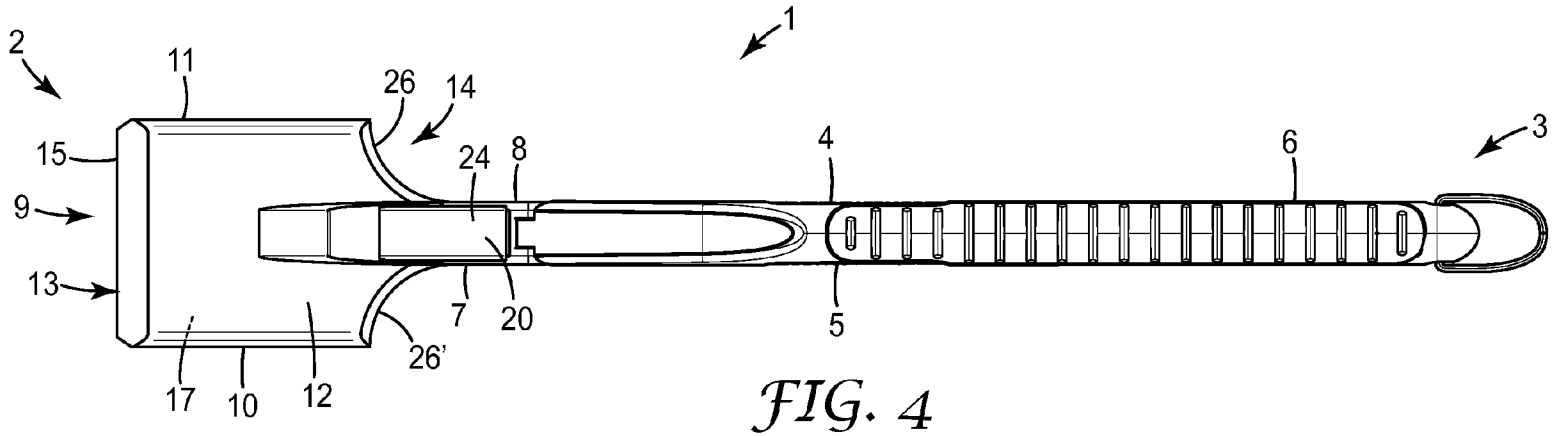
FIG. 4 is a top view of the tool of FIG. 3.
Figure 5:
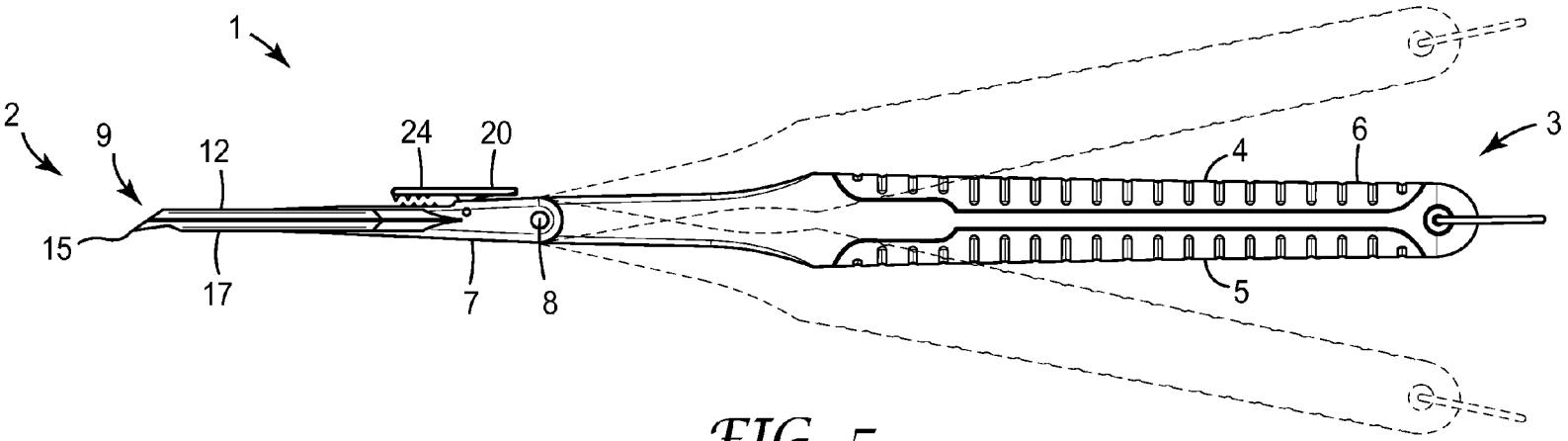
FIG. 5 is a side view of the tool of FIG. 3, showing different angles that can be established by way of a hinged connection.

Cleaning head 9 may comprise at least one fastener 20 by which cleaning pad 40 can be secured in place on cleaning head 9. With reference to FIGS. 3-5, in some embodiments such a fastener 20 may comprise e.g. at least one clamp 24 that may be located at a rearward edge (end) 14 of cleaning head 9 and that is changeable from a first, unclamped position that permits sheetlike cleaning pad 40 to be slidably mounted on cleaning head 9, to a second, clamped position in which a surface of clamp 24 applies pressure to a rearward portion of cleaning pad 40 so as to secure cleaning pad 40 in place on the cleaning head. If desired, rearward edge 14 of cleaning pad 40 may comprise a notch 52 (most clearly visible in FIG. 9) configured to receive a surface of clamp 24 (as shown e.g. in FIG. 2).

Figure 6:
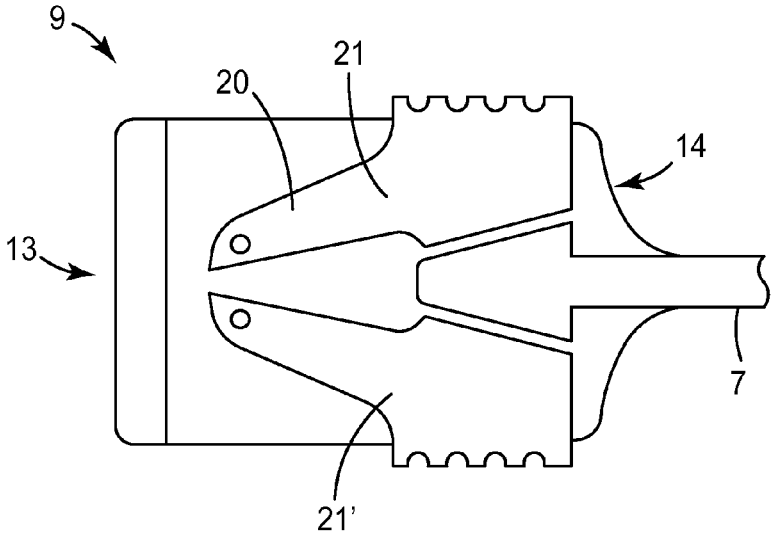
FIG. 6 is a top view of a cleaning head comprising an expandable fastener in an expanded position which enables a fryer cleaning pad to be held thereon.
Figure 7:
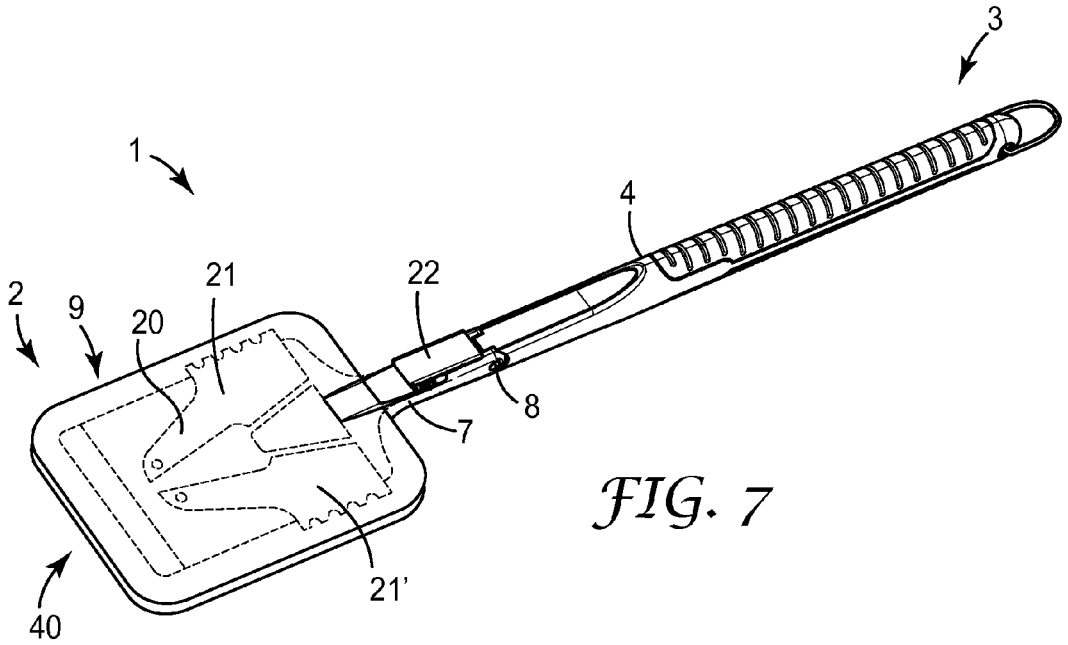
FIG. 7 is a perspective view of a cleaning tool comprising the cleaning head of FIG. 6, with a cleaning pad being held on the cleaning head by the expandable fastener of FIG. 6.

With reference to FIGS. 6 and 7, in some embodiments such a fastener 20 may comprise an expandable fastener with at least one portion 21 that is movable from a first, unexpanded position that permits sheetlike cleaning pad 40 to be slidably mounted on the cleaning head (so that at least a portion of fastener 20 is inside slitlike cavity 45), to a second, expanded position in which a surface of movable portion 21 of fastener 20 presses against a surface of cleaning pad 40 within slitlike cavity 45 of the cleaning pad so as to secure the cleaning pad in place on the cleaning head. In the particular embodiment shown in FIGS. 6 and 7, two such movable portions are used (21 and 21') and are actuated by trigger 22. (In FIG. 7, the two movable portions (shown in phantom within cavity 45) are in their second, expanded position so as to secure cleaning pad 40 in place.) If desired, such a movable portion may have features that enhance the ability of the portion to press against a surface of cleaning pad 40 so as to hold pad 40 in place; e.g. the serrations that are shown on movable portions 21 in FIG. 6. It will be appreciated however that any suitable securing mechanism can be used. In a more general sense, it will also be appreciated that any suitable clamping, fastening, etc. mechanism can be used to secure cleaning pad 40 in place on cleaning head 9. Such fastening and securing will be removable, however, such that a used cleaning pad 40 may be removed and a replacement pad 40 secured in its place. Such removable fastening may be optionally augmented e.g. by fasteners present on either or both of major surfaces 12 and 17 of cleaning head 9. Such fasteners should of course be compatible with the slidable mounting of cleaning pad 40 onto cleaning head 9. Such fasteners might include e.g. directional hooks that are oriented so as to allow cleaning pad 40 to be slidably mounted onto cleaning head 9, but that then retard the ability of pad 40 to slide back off cleaning head 9, unless e.g. a user grasps one or more portions of pad 40 so as to free those portions of pad 40 from at least some of the hooks so that pad 40 can then be removed.

In various embodiments, cleaning head 9 of tool 1 may comprise additional features. In some embodiments, forward edge 13 of cleaning head 9 can be tapered, and in specific embodiments can comprise a scraping blade 15 (e.g. with a long axis that is oriented generally normal to the long axis of grippable portion 5 of shaft 4), as seen most clearly in FIGS. 3 and 5. Scraping blade 15 may comprise any suitable material that may be used to scrape adhered material off of a fryer surface, and may be integrally formed with the rest of cleaning head 9, or may be a separate piece (e.g., a metal blade) that is embedded partially in, or otherwise attached to, head 9, so as to protrude forwardly from head 9.

In some embodiments, at least a portion of one of forward edge 13, rearward edge 14, or first or second side edges 10 or 11 of cleaning head 9, may comprise at least one concave contour configured to support a portion of the fryer cleaning pad in a concave geometry. For example, in particular embodiments exemplified in e.g. FIG. 4, rearward edge 14 of cleaning head 9 may comprise two rearward edge sections that laterally flank (across the width direction of cleaning head 9) a connection of cleaning head 9 to shaft 4, and which rearward edge sections comprise concave contours 26 and 26' configured to support portions of a fryer cleaning pad in a concave geometry. Designs of this general type may render tool 1 particularly suitable for cleaning tubular components (e.g., of fryer heating elements and the like). That is, a concave contour may allow a portion of a cleaning pad 40 to deform thereinto and to be supported thereby, so that that portion of the cleaning pad can closely conform to the surface of a tubular component so as to more effectively clean the component. Such concave contours are not limited to edges of cleaning head 9, however. In some embodiments, a major surface (e.g., surface 12 or 17) of cleaning head 9 may comprise a concave contour, as shown e.g. in FIG. 11. Whether in a cleaning head 9 or in a cleaning pad 40, such a concave contour may comprise a radius of curvature of e.g. at least 1, 2, 3, or 4 cm.

Cleaning head 9 is configured to receive and support a sheetlike, resilient fryer cleaning pad 40. By resilient is meant that fryer cleaning pad 40 is conformable at least to the extent of conforming somewhat to the shape of a fryer surface against which cleaning pad 40 is pressed, but that, after the pressing force is removed, resilient pad 40 returns substantially to its previous shape and thickness. As such, resilient pad 40 will be distinguished from such soft, weak materials as would not return substantially to their previous shape and thickness after being used to clean a fryer surface, and in particular will be distinguished from materials that are so weak and soft as to be significantly damaged or destroyed when used to clean a fryer surface. As such, resilient pad 40 by definition excludes cellulosic materials, water-soluble or water-softenable materials, and the like, that are commonly used for less aggressive cleaning operations such as general household use and the like.

In view of the above discussions, a fryer cleaning pad 40 to be used with tool 1 may comprise any suitable fibrous web (in this context, the term pad specifically excludes brushes and the like) that is suitable for cleaning a fryer. It will be recognized that fryers are often still hot while being cleaned, and can have oxidized material baked onto the fryer surface that may be difficult to remove. Thus, a suitable material should be able to tolerate such temperatures, and should survive the physical rigors of the cleaning process. Fryer cleaning pad 40 may comprise major cleaning surfaces 41 and 42 that are configured to scrub, scour, abrade, etc., as needed to remove adhered material from a fryer surface.

In some embodiments, fryer cleaning pad 40 may be comprised of a fibrous nonwoven web comprising abrasive particles attached to the fibers thereof.

In some particular embodiments, fryer cleaning pad 40 may comprise a coherent bonded-fiber nonwoven web made of interlaced randomly disposed flexible organic thermoplastic fibers at least some of which are adhesively bonded together by binder at points where the fibers intersect and contact each other, to form a web having three-dimensionally integrated structure. Abrasive particles may be distributed throughout the web and bonded to the web by binder. The interstices between the fibers of the web are substantially unfilled with binder or abrasive. Such webs are typically flexible and readily compressible and, upon release of pressure, are capable of recovering substantially completely to its initial uncompressed form. Examples of webs of this type are disclosed in U.S. Pat. No. 2,958,593, and are available from 3M Company, St. Paul, Minn. under the trade designation SCOTCH-BRITE.

In some particular embodiments, fryer cleaning pad 40 may comprise a coherent bonded-fiber nonwoven web made of first and second crimped, staple, organic bicomponent thermoplastic fibers, in which at least some of the first and second fibers of the web are melt-bonded together at least at a portion of the points where they contact each other. At least a portion of the first and second fibers of one major surface of the nonwoven web may have an abrasive coating (e.g., abrasive particles) bonded thereto, and at least a portion of the first and second fibers of the interior region may have no abrasive coating bonded thereto. Examples of webs of this type are disclosed in U.S. Pat. No. 5,685,935.

In some embodiments, fryer cleaning pad 40 may comprise a coherent bonded-fiber nonwoven web made of inter-engaged continuous coiled or three-dimensionally undulated filaments of resilient thermoplastic polymer. At least some of the filaments are autogeneously bonded together or removably welded together at points of mutual contact to form a handleably integrated structure. The web may comprise abrasive granules dispersed throughout the web and bonded to the filaments by binder. Examples of webs of this type are disclosed in U.S. Pat. Nos. 3,837,988 and 4,227,350.

In some embodiments, fryer cleaning pad 40 may comprise a coherent bonded-fiber nonwoven web that is a sponge-like, compressible, web made of randomly intermingled and randomly bonded hydrophobic fibers. The randomly intermingled fibers are bonded together either through fusion or with a binder at randomly spaced points where the fibers cross. The fibers of the web define, in effect, walls of a large multiplicity of open cells, which impart a high void volume to the web. Examples of webs of this type are disclosed in U.S. Pat. Nos. 3,537,121 and 3,910,284.

Figure 8:
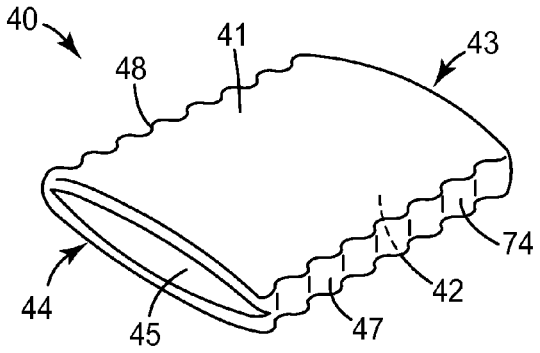
FIG. 8 is a perspective side-rear view of an exemplary sheetlike fryer cleaning pad with an open-ended slitlike cavity therewithin and with serrated side edges.
Figure 9:
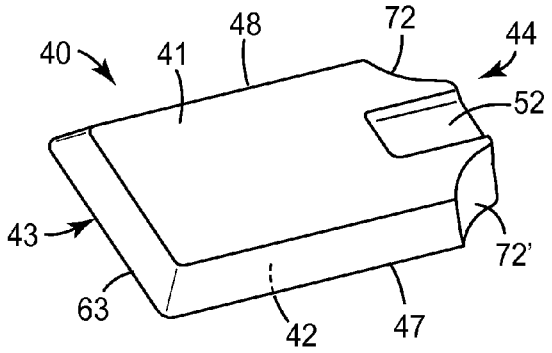
FIG. 9 is a perspective front-side view of another exemplary sheetlike fryer cleaning pad, with a tapered forward edge with tapered side edges.

Sheetlike fryer cleaning pad 40 may comprise first and second major surfaces 41 and 42, forward and rearward edges 43 and 44, and first and second side edges 47 and 48, as shown e.g. in FIGS. 8 and 9. Sheetlike cleaning pad 40 may also comprise one or more concave contours in any of these edges.

For example, in the particular embodiments exemplified in FIGS. 2 and 9, rearward edge 44 of pad 40 comprises two rearward edge sections that, when pad 40 is in place upon head 9, laterally flank a connection of cleaning head 9 to shaft 4. As seen in FIGS. 2 and 9, these rearward edge sections may respectively comprise concave contours 72 and 72' that are supported by underlying contours 26 and 26' of rearward edge 14 of cleaning head 9. Such arrangements can facilitate e.g. the cleaning of the underside of tubular items, e.g. fryer heating elements. In another exemplary embodiment illustrated in FIG. 10, side edges 47 and 48 of cleaning pad 40 respectively comprise concave contours 71 and 71' (as well as concave contours in rearward edge 14, of the type mentioned above). In still another exemplary embodiment illustrated in FIG. 11, forward edge 13 comprises concave contour 75; in addition, major surface 42 comprises a concave contour 73. In such cases in which major surface 42 comprises a concave contour, such a contour may extend e.g. along at least 50% of the length of cleaning pad 40 along a direction generally parallel to the long axis of the shaft. At the rearward end of concave contour 73, contour 73 may gradually become shallower so as to transition to a general flat (planar) rearward portion of major surface 42. It will be appreciated that any combination of the above concave contours, in any of the above edges and/or surfaces, can be used as desired.

Figure 10:
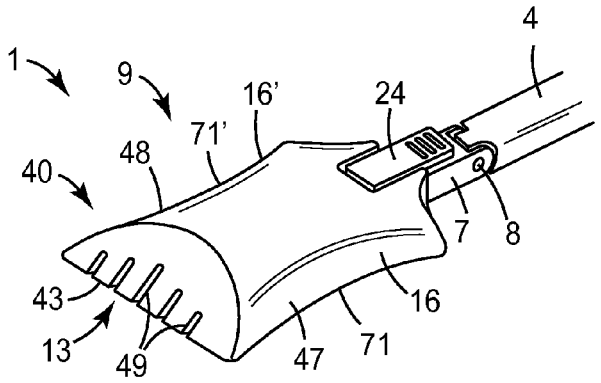
FIG. 10 is a perspective view of another exemplary sheetlike fryer cleaning pad shown mounted on an exemplary cleaning head, the pad comprising a plurality of slits in the forward edge thereof, and comprising concave contours in side edges thereof.
Figure 11:
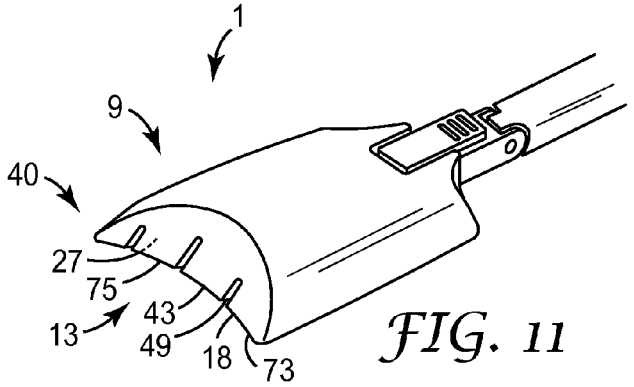
FIG. 11 is a perspective view of another exemplary sheetlike fryer cleaning pad shown mounted on an exemplary cleaning head, the pad comprising a plurality of slits in the forward edge thereof, and comprising a concave contour in a front edge thereof and a concave contour in a major surface thereof.

In some embodiments, an edge of cleaning pad 40, e.g. forward edge 43, may comprise one or more slits 49 as shown in exemplary embodiment in FIGS. 10 and 11. Such slits may e.g. be spaced across the width of forward edge 43. In some embodiments, at least a portion of any edge of cleaning pad 40 may be serrated (meaning having undulating (e.g., scalloped) areas with a radius of curvature of less than 1 cm), as exemplified by side edge 47 of FIG. 8.

In embodiments in which cleaning pad 40 is to be used with a cleaning head 9 that has a sharp end/edge (e.g., a cleaning head with a teardrop shape and/or a scraping blade), a portion of cleaning pad 40 that will abut the sharp end or blade when pad 40 is in place on cleaning head 9, can comprise a reinforced area 46 (provided e.g. by way of a reinforcing scrim, seam, or mesh, by a densified area of the pad, etc.), as indicated in FIG. 2. This may provide that this portion of cleaning pad 40 is not unacceptably cut or otherwise damaged in using tool 1 with pad 40 in place. In embodiments in which a sharp end or scraping blade is not present, no such reinforcement may be needed.

Figure 12:
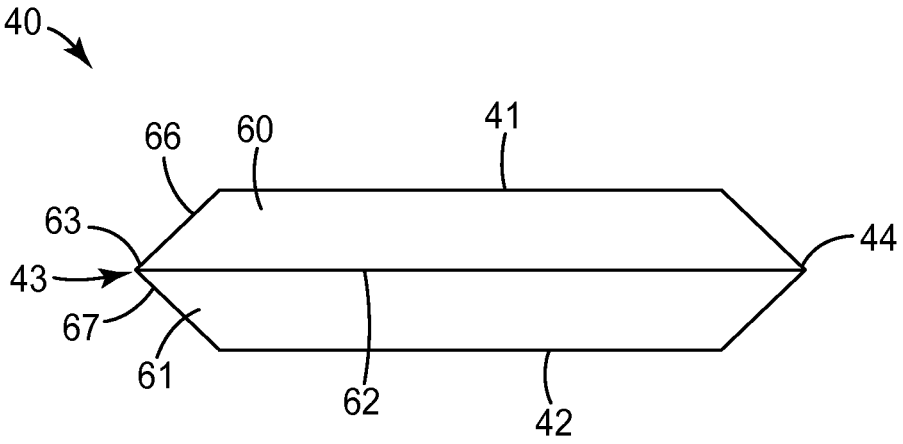
FIG. 12 is a side view of an exemplary multilayer fryer cleaning pad with a tapered forward edge.
Figure 13:
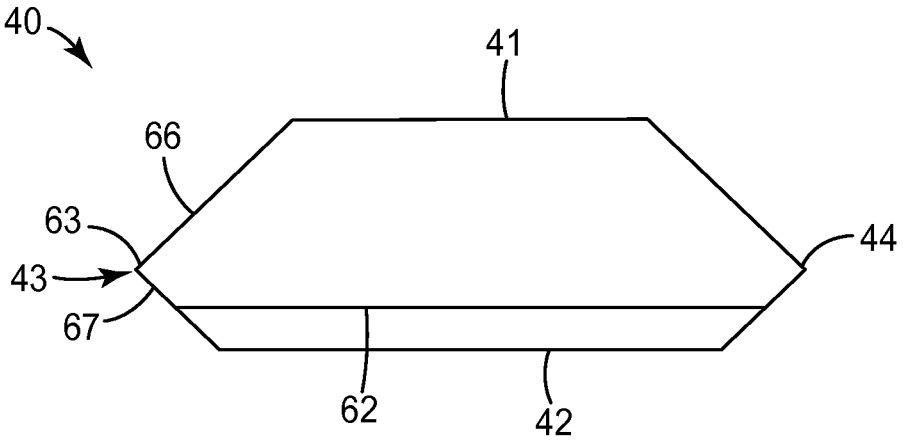
FIG. 13 is a side view of an exemplary multilayer fryer cleaning pad with an asymmetrically tapered forward edge and with an asymmetric multilayer structure.

Forward and rearward edges 43 and 44, and side edges 47 and 48, of cleaning pad 40, may have any suitable profile. For example, side edges 47 and 48 as shown in the exemplary embodiment of FIG. 8 are not noticeably tapered or wedge-shaped. In other embodiments, an edge can comprise a tapered profile e.g. so as to be wedge-shaped. By way of specific example, in FIG. 12 is shown (in side view) a cleaning pad 40 in which forward edge 43 comprises a tapered profile configured such that forward edge 43 comprises first and second forward edge surfaces 66 and 67 that meet at nose 63. In various embodiments, forward edge surfaces 66 and 67 may be angled away from each other (i.e., with reference to the major planes thereof) by at least 25, 45, 65, or 85 degrees (with a divergence angle of approximately 90 degrees being shown in the exemplary illustration of FIG. 12). In particular embodiments, forward edge 43 may comprise an asymmetrically tapered profile so as to comprise an asymmetric wedge shape as shown in FIG. 13, such that the surface area of first edge surface 66 is larger than the surface area of second edge surface 67. In various embodiments, the area of first edge surface 66 may exceed that of second edge surface 67 by at least 20, 40, 60 or 80%. In some cases, the asymmetry may be so great that the area of first edge surface 66 exceeds that of second surface 67 by 90, 95, or 98%.

It will be understood that while the above discussions have focused on forward edge 43, any edge of cleaning pad 40 may be similarly tapered or asymmetrically tapered. In various embodiments, one or more edges may be tapered and/or asymmetrically tapered, with one or more other edges not being tapered. It will be appreciated that such tapered edges may facilitate cleaning of tight crevices, corners, and the like.

In some particular embodiments, fryer cleaning pad 40 may be comprised of a multiple (e.g., first and second) layers, e.g. layers 60 and 61 as shown in FIG. 12. In some embodiments, such layers may differ in e.g. abrasiveness or scouring power. For example, layer 60 might comprise abrasive particles with e.g. a Mohs hardness of greater than 8, and layer 61 might comprise abrasive particles of less abrasiveness, e.g. with Mohs hardness in the range of 3-7. Such combinations are discussed in further detail in U.S. Pat. No. 4,078,340, and may allow a portion of pad 40 of desired abrasiveness to be brought to bear onto a particular fryer surface to be cleaned. (For example, it might be desired to use a cleaning layer of lower abrasiveness to clean e.g. a heating element that has a protective coating.) In other embodiments, a multilayer pad 40 may comprise a first layer (e.g., an outer layer) that is a cleaning layer comprising abrasive particles, and at least a second layer (e.g., an inner layer) that is a reservoir layer comprising a liquid cleaning composition, wherein the reservoir layer is configured to release at least some of the liquid cleaning composition into the cleaning layer upon the application of pressure to the reservoir layer e.g. in the act of manually pressing cleaning head 9 with cleaning pad 40 thereupon, against a fryer surface.

In still further embodiments, a multilayer cleaning pad 40 can comprise an asymmetrically layered arrangement, meaning that one of the layers is at least 20% thicker than another of the layers. In various embodiments, the thicker layer can be at least 40, 60, or 80% thicker than another of the layers. Such an arrangement can provide that the interface 62 between the two layers 60 and 61 may be located away from nose 63, as in FIG. 13 (rather than coinciding with nose 63 as in FIG. 12). With reference to the specific exemplary design of FIG. 13, this can provide that, at the forward edge of pad 40, layer 60 provides not only first surface area 66, but also provides nose 63, and at least a portion of second surface area 67 that is adjacent nose 63. Such an arrangement can ensure that a layer 60 of particular abrasiveness (e.g., which is particularly suitable for the cleaning of e.g. crevices and corners) is most easily brought to bear on such locations, while layer 61 of a different abrasiveness may be used primarily e.g. for cleaning of flat surfaces. In specific embodiments, a cleaning pad 40 can comprise an edge (e.g., a forward edge) with an asymmetric wedge shape, in combination with an asymmetric multilayer structure, as shown in exemplary embodiment in FIG. 13. And, of course, any of these arrangements may be applied to edges other than a forward edge.

Tool 1 may be used to manually clean any fryer surface, meaning tool 1 is held by hand by a person and manually moved (without any kind of motorized apparatus) across the fryer surfaces. Tool 1 may be particularly suitable for cleaning surfaces that are deep in a fryer (e.g., surfaces below heating elements), for cleaning the heating elements themselves (such heating elements are often elongated tubes), and so on. In particular, tool 1 may be useful in cleaning the underside of heating elements which might otherwise be quite difficult to reach and clean. In some embodiments, cleaning pad 40 may be removed if desired to expose and use scraping blade 15 (if cleaning head 9 comprises such a blade). In at least some embodiments, at least components of fryer cleaning tool 1 that contact or most closely approach fryer surfaces, as well as fryer cleaning pad 40, may be made of materials that can withstand temperatures up to or even greater than the typical operating temperature of fryers to be cleaned (since, in some cases, cleaning may be performed with a fryer still at a high temperature). Fryer cleaning tools as described herein may be used with any suitable liquid fryer cleaning composition (whether such liquid is e.g. impregnated into a reservoir layer, is supplied already impregnated into a cleaning layer, is impregnated into the cleaning layer by the user, or is poured onto a fryer surface to be cleaned). Non-liquid cleaners may also be used, of course.

In some embodiments, the fryer cleaning tools disclosed herein can be provided as part of a fryer cleaning system, comprising a kit in which one or more fryer cleaning tools may be packaged along with at least two fryer cleaning pads. Such kits may also optionally include one or more of: at least one cleaning composition (e.g., that can withstand a temperature at least up to the operating temperature of the fryer to be cleaned); a rinse solution for removing residual cleaning composition; an absorbent material (e.g., in the form of one or more pads) which may be convenient e.g. for removing of excess grease, cleaning composition, and/or rinsing solution; personal protective equipment (e.g., gloves, eyewear, etc.); and, instructions for use of the fryer cleaning tool and other components of the kit. Suitable cleaning compositions that might be optionally packaged in such a kit include e.g. the commonly used aqueous-alkali formulations and the like. Fryer cleaning tools, kits containing such tools, etc., that are disclosed herein can be used in the cleaning of any fryer surface. The tools can be used in combination with any suitable cleaning compositions (e.g., commonly used aqueous-alkali formulations), and/or in combination with such well-known cleaning methods as cold-soak and boil-out cleaning methods. The tools and/or kits can be used to clean any suitable fryer (e.g., whether electric or gas).

List of Exemplary Embodiments

Embodiment 1. A fryer cleaning tool, comprising: an elongated shaft with a first, working end with a sheetlike cleaning head and with a second, grippable end; wherein the sheetlike cleaning head is configured to receive a sheetlike resilient fryer cleaning pad with an open-ended slitlike cavity therewithin, which fryer cleaning pad can be slidably mounted onto the cleaning head such that a major portion of the cleaning head resides within the cavity of the fryer cleaning pad, wherein the cleaning head comprises a length, a width, and a thickness, and a forward edge, a rearward edge, and first and second side edges, and comprises first and second major surfaces that are configured to support first and second oppositely-facing major cleaning surfaces of the fryer cleaning pad, and wherein the cleaning head comprises at least one fastener by which the fryer cleaning pad can be secured in place on the cleaning head.

Embodiment 2. The tool of embodiment 1 wherein at least a portion of one of the forward edge, rearward edge, or first or second side edges of the cleaning head, comprises a concave contour.

Embodiment 3. The tool of embodiment 2 wherein the cleaning head comprises two rearward edge sections laterally flanking a connection of the cleaning head to the shaft, and wherein the rearward edge sections comprise concave contours.

Embodiment 4. The tool of any of embodiments 1-3 wherein a portion of the shaft between the cleaning head and the grippable end of the shaft comprises a hinged connection, or wherein the cleaning head is connected to the shaft by a hinged connection, such that an angle between a long axis of the grippable end of the shaft, and a long axis of the cleaning head, can be changed.

Embodiment 5. The tool of any of embodiments 1-3 wherein the forward edge of the cleaning head comprises a tapered edge.

Embodiment 6. The tool of embodiment 5 wherein the tapered forward edge of the cleaning head comprises a scraping blade that is exposed when a cleaning pad is not mounted on the cleaning head.

Embodiment 7. The tool of any of embodiments 1-6 wherein the fastener is an expandable fastener with at least one portion that is movable from a first, unexpanded position that permits the sheetlike cleaning pad to be slidably mounted on the cleaning head, to a second, expanded position in which a surface of the movable portion of the fastener presses against an surface of the cleaning pad within the slitlike cavity of the cleaning pad so as to secure the cleaning pad in place on the cleaning head.

Embodiment 8. The tool of any of embodiments 1-7 wherein the fastener is a clamping fastener located at a rearward end of the cleaning head and that is changeable from a first, unclamped position that permits the sheetlike cleaning pad to be slidably mounted on the cleaning head, to a second, clamped position in which a surface of the clamp applies pressure to a rearward portion of the cleaning pad so as to secure the cleaning pad in place on the cleaning head.

Embodiment 9. The tool of any of embodiments 1-8 comprising a resilient, sheetlike fryer cleaning pad mounted on, and releasably attached to, the sheetlike cleaning head, so that a major portion of the cleaning head resides within an open-ended slitlike cavity of the fryer cleaning pad and so that first and second oppositely-facing major cleaning surfaces of the cleaning pad are supported by first and second oppositely-facing major surfaces of the fryer cleaning pad.

Embodiment 10. The tool of embodiment 9 wherein at least a portion of one of a forward edge, a rearward edge, or first or second side edges of the cleaning pad, comprises a concave contour.

Embodiment 11. The tool of any of embodiments 9-10 wherein at least a portion of a first major surface of the cleaning pad comprises a concave contour that extends along at least 50% of a length of the cleaning pad along a direction generally parallel to a long axis of the shaft.

Embodiment 12. The tool of any of embodiments 9-11 wherein at least a portion of one of a forward edge, rearward edge, or first or second side edges of the cleaning pad, comprises a serrated edge.

Embodiment 13. The tool of any of embodiments 9-12 wherein a portion of the cleaning pad that is positioned forward of the forward edge of the cleaning head, has a reinforced area.

Embodiment 14. The tool of any of embodiments 9-13 wherein a forward edge of the cleaning pad comprises a tapered edge configured such that the forward edge of the cleaning pad comprises first and second forward edge surfaces that are angled away from each other by at least 45 degrees.

Embodiment 15. The tool of embodiment 14 wherein the tapered forward edge of the cleaning pad comprises an asymmetric wedge shape such that the surface area of the first forward edge surface is larger than the surface area of the second forward edge surface by at least 20%.

Embodiment 16. The tool of any of embodiments 9-15 further comprising a plurality of slits spaced along a forward edge of the cleaning pad.

Embodiment 17. The tool of any of embodiments 9-16 wherein a rearward edge of the cleaning pad comprises a notch configured to receive a surface of a clamp located on a rearward end of the cleaning head.

Embodiment 18. The tool of any of embodiments 9-17 wherein the fryer cleaning pad is comprised of a fibrous nonwoven web comprising abrasive particles bonded to fibers thereof.

Embodiment 19. The tool of embodiment 18 wherein the fryer cleaning pad is a multilayer pad comprising a first layer comprising first abrasive particles and a second layer comprising second abrasive particles that are less abrasive than the first abrasive particles of the first layer.

Embodiment 20. The tool of embodiment 19 wherein a forward edge of the multilayer cleaning pad comprises an asymmetric wedge shape and wherein the multilayer cleaning pad comprises an asymmetric multilayer structure.

Embodiment 21. The tool of embodiment 18 wherein the fryer cleaning pad is a multilayer cleaning pad comprising at least one cleaning layer comprising abrasive particles and at least one reservoir layer that comprises a liquid cleaning composition, wherein the reservoir layer is configured to release at least some of the liquid cleaning composition into the cleaning layer upon the application of pressure to the reservoir layer by manually pressing the cleaning head of the tool against a fryer surface.

Embodiment 22. A method of cleaning a fryer comprising manually manipulating the tool of any of embodiments 9-21 so that the fryer-cleaning pad is brought into contact with fryer surfaces and is moved back and forth across the fryer surfaces.

Embodiment 23. A kit comprising a fryer cleaning tool of any of embodiments 1-8 and further comprising at least two fryer cleaning pads packaged along with the fryer cleaning tool, the kit optionally further comprising any or all of: at least one cleaning composition, at least one rinse solution, at least one absorbent pad, at least one article of personal protective equipment, and instructions for use of the fryer cleaning tool and other components of the kit.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention not merely those representative designs that were chosen to serve as exemplary illustrations. Thus, the scope of the present invention should not be limited to the specific illustrative structures described herein, but rather extends at least to the structures described by the language of the claims, and the equivalents of those structures. To the extent that there is a conflict or discrepancy between this specification as written and the disclosure in any document incorporated by reference herein, this specification as written will control.

What is claimed is:

1. A fryer cleaning tool, comprising;

an elongated shaft with a first, working end with a sheetlike, rigid cleaning head and with a second, grippable end;

wherein the sheetlike, rigid cleaning head is configured to receive a sheetlike resilient fryer cleaning pad with an open-ended slitlike cavity therewithin, which fryer cleaning pad can be slidably mounted onto the rigid cleaning head such that a major portion of the rigid cleaning head resides within the cavity of the fryer cleaning pad, wherein the rigid cleaning head comprises a length, a width, and a thickness, and a forward edge, a rearward edge, and first and second side edges, and comprises first and second major surfaces that are configured to support first and second oppositely-facing major cleaning surfaces of the fryer cleaning pad, wherein the rigid cleaning head comprises at least one fastener by which the fryer cleaning pad can be secured in place on the rigid cleaning head, and wherein the forward edge of the rigid cleaning head comprises a tapered edge, wherein the tapered forward edge of the rigid cleaning head comprises a scraping blade that is integrally formed with the rigid cleaning head and that is exposed when a cleaning pad is not mounted on the rigid cleaning head of the fryer cleaning tool.

2. The tool of claim 1 wherein at least a portion of one of the forward edge, rearward edge, or first or second side edges of the cleaning head, comprises a concave contour.

3. The tool of claim 2 wherein the cleaning head comprises two rearward edge sections laterally flanking a connection of the cleaning head to the shaft, and wherein the rearward edge sections comprise concave contours.

4. The tool of claim 1 wherein a portion of the shaft between the cleaning head and the grippable end of the shaft comprises a hinged connection, or wherein the cleaning head is connected to the shaft by a hinged connection, such that an angle between a long axis of the grippable end of the shaft, and a long axis of the cleaning head, can be changed.

5. The tool of claim 1 wherein the fastener is an expandable fastener with at least one portion that is movable from a first, unexpanded position that permits the sheetlike cleaning pad to be slidably mounted on the cleaning head, to a second, expanded position in which a surface of the movable portion of the fastener presses against an surface of the cleaning pad within the slitlike cavity of the cleaning pad so as to secure the cleaning pad in place on the cleaning head.

6. The tool of claim 1 wherein the fastener is a clamping fastener located at a rearward end of the cleaning head and that is changeable from a first, unclamped position that permits the sheetlike cleaning pad to be slidably mounted on the cleaning head, to a second, clamped position in which a surface of the clamp applies pressure to a rearward portion of the cleaning pad so as to secure the cleaning pad in place on the cleaning head.

7. The tool of claim 1 comprising a resilient, sheetlike fryer cleaning pad mounted on, and releasably attached to, the sheetlike cleaning head, so that a major portion of the cleaning head resides within an open-ended slitlike cavity of the fryer cleaning pad and so that first and second oppositely-facing major cleaning surfaces of the fryer cleaning pad are supported by first and second oppositely-facing major surfaces of the sheetlike cleaning head.

8. The tool of claim 7 wherein at least a portion of one of a forward edge, a rearward edge, or first or second side edges of the cleaning pad, comprises a concave contour.

9. The tool of claim 7 wherein at least a portion of a first major surface of the cleaning pad comprises a concave contour that extends along at least 50% of a length of the cleaning pad along a direction generally parallel to a long axis of the shaft.

10. The tool of claim 7 wherein at least a portion of one of a forward edge, rearward edge, or first or second side edges of the cleaning pad, comprises a serrated edge.

11. The tool of claim 7 wherein a portion of the cleaning pad that is positioned forward of the forward edge of the cleaning head, comprises a reinforced area.

12. The tool of claim 7 wherein a forward edge of the cleaning pad comprises a tapered edge configured such that the forward edge of the cleaning pad comprises first and second forward edge surfaces that are angled away from each other by at least 45 degrees.

13. The tool of claim 12 wherein the tapered forward edge of the cleaning pad comprises an asymmetric wedge shape such that the surface area of the first forward edge surface is larger than the surface area of the second forward edge surface by at least about 20%.

14. The tool of claim 7 further comprising a plurality of slits spaced along a forward edge of the cleaning pad.

15. The tool of claim 7 wherein a rearward edge of the cleaning pad comprises a notch configured to receive a surface of a clamp located on a rearward end of the cleaning head.

16. The tool of claim 7 wherein the fryer cleaning pad is comprised of a fibrous nonwoven web comprising abrasive particles bonded to fibers thereof.

17. The tool of claim 16 wherein the fryer cleaning pad is a multilayer pad comprising a first layer comprising first abrasive particles and a second layer comprising second abrasive particles that are less abrasive than the first abrasive particles of the first layer.

18. The tool of claim 17 wherein a forward edge of the multilayer cleaning pad comprises an asymmetric wedge shape and wherein the multilayer cleaning pad comprises an asymmetric multilayer structure.

19. The tool of claim 16 wherein the fryer cleaning pad is a multilayer cleaning pad comprising at least one cleaning layer comprising abrasive particles and at least one reservoir layer that comprises a liquid cleaning composition, wherein the reservoir layer is configured to release at least some of the liquid cleaning composition into the cleaning layer upon the application of pressure to the reservoir layer by manually pressing the cleaning head of the tool against a fryer surface.

* * * * *